US005957620A

United States Patent [19]

Thomas et al.

[11] Patent Number: 5,957,620

[45] Date of Patent: Sep. 28, 1999

[54] METHOD OF INSTALLING RESPECTIVE DEPRESSIONS UTILIZING COOPERATION BETWEEN MILLING ACTIONS OF MULTIPLE CUTTING TOOLS AND MACHINE TO PERFORM SAME

[76] Inventors: Glen Edward Thomas; Amona Dianne Thomas, both of P.O. Box 1083, Moore Haven, Fla. 33471

[21] Appl. No.: 08/986,475

[22] Filed: Dec. 8, 1997

Related U.S. Application Data

[63] Continuation-in-part of application No. 08/625,206, Apr. 1, 1996, Pat. No. 5,695,299, which is a continuation-in-part of application No. 08/471,858, Jun. 6, 1995, Pat. No. 5,503,499, and application No. 08/513,355, Aug. 10, 1995, Pat. No. 5,607,255, which is a continuation-in-part of application No. 08/391,708, Feb. 21, 1995, Pat. No. 5,484,228, which is a continuation-in-part of application No. 08/118,961, Sep. 10, 1993, Pat. No. 5,391,017.

[51] Int. Cl.[6] ..... E01C 23/09

[52] U.S. Cl. ..... 404/72; 404/75; 404/94

[58] Field of Search ..... 404/72, 90, 93, 404/94, 75

[56] References Cited

U.S. PATENT DOCUMENTS

| | | | |
|---|---|---|---|
| 5,094,565 | 3/1992 | Johnson | 404/75 |
| 5,297,894 | 3/1994 | Yenick | 404/90 |
| 5,391,017 | 2/1995 | Thomas et al. | 299/39.6 |
| 5,456,547 | 10/1995 | Thomas et al. | 404/72 |
| 5,484,228 | 1/1996 | Thomas et al. | 404/90 |
| 5,503,499 | 4/1996 | Thomas et al. | 404/72 |
| 5,607,255 | 3/1997 | Thomas et al. | 404/90 |
| 5,676,490 | 10/1997 | Nelson | 404/94 |
| 5,681,129 | 10/1997 | Nicodemo et al. | 404/72 |
| 5,695,299 | 12/1997 | Thomas et al. | 404/94 |

*Primary Examiner*—James A. Lisehora

[57] ABSTRACT

A method of milling is disclosed wherein mill actions from at least two cutting tools cooperate to form each respective depression in a surface of a road. These depression are generally utilized in series to inform an operator of a motor vehicle, using the produced vibration and/or noise, that the motor vehicle has left a normal driving area of the road. Variations of the invention include different methods of regulating elevational movement of each respective cutting tool. These methods include use of eccentric wheels, cam members and electronic control. Stationary positioning of each respective cutting tool on the depression installation machine is explained as is displaceable positioning wherein each respective cutting tool may be moved in a reciprocating manner to decrease operating time where the cutting tool is not capable of performing a milling action. Use of multiple cutting tool sets provide for each respective set to cooperate to form select depressions within a series of depressions. The different methods of determining milling depth of each respective cutting tool is explained with examples given.

16 Claims, 10 Drawing Sheets

22
26
20
24
42
34
40
28
36
38
30
32

22
26
44
24
46
48

'prior art'

'prior art'

'prior art'

'prior art'

'prior art'

'prior art'

'prior art'

'prior art'

'prior art'

'prior art'

'prior art'

'prior art'

'prior art'

'prior art'

METHOD OF INSTALLING RESPECTIVE DEPRESSIONS UTILIZING COOPERATION BETWEEN MILLING ACTIONS OF MULTIPLE CUTTING TOOLS AND MACHINE TO PERFORM SAME

CROSS-REFERENCES

This application is a continuation-in-part application of U.S. Ser. No. 08/625,206, filed Apr. 1, 1996, entitled "Multi-Tooled Depression Milling Machine", which is a continuation-in-part application of U.S. Pat. No. 5,607,255 and U.S. Pat. No. 5,503,499; U.S. Pat. No. 5,607,255 is further identified by Ser. No. 08/513,355, filed Aug. 10, 1995, entitled "Method of Milling Through to Form Highway Depressions" which is a continuation-in-part application of U.S. Pat. No. 5,484,228, Ser. No. 08/391,708, filed Feb. 21, 1995, entitled "Continuous Moving Highway Depression Cutting"; which is a continuation-in-part application of U.S. Pat. No. 5,391,017, Ser. No. 08/118,961, filed Sep. 10, 1993, entitled "Continuous Moving Depression Cutting Tool for Highway Use "; U.S. Pat. No. 5,503,499 is further identified by Ser. No. 08/471,858, filed Jun. 6, 1995, entitled "Impact Formed Depressions and Installation Machine". This application is related to U.S. Pat. No. 5,456,547, Ser. No. 08/179,672 filed Jan. 11, 1994, entitled "Cutting of Repetitive Depressions in Roadway Surface". All of these applications are incorporated herein by this reference.

BACKGROUND

1. Field of the Invention

Generally, the invention relates to machines to install depressions in the surface of a road. More specifically, the invention relates to such machines which utilize a cooperation between milling actions of at least two (2) cutting tools to form each respective depression.

2. Description of the Prior Art

It has been known for some time that the installation of a series of depressions into a surface of a road adjacent a normal driving lane significantly reduces accidents along the road. This is the result of an operator of a motor vehicle being informed, by the vibration and/or noise created by contact of the tires of the motor vehicle with the depressions, that the motor vehicle has left the normal driving lane.

Generally, the series of depressions will be installed along a defining boundary of the road. These boundaries are along the road adjacent an edge of the normal driving area. For divided highways, where the driving area is designed for unidirectional travel, these boundaries exist on both sides of the road and may have multiple driving lanes therebetween. For bidirectional highways these boundaries exist on the left hand side and optionally, may exist at a center line separating the traffic moving in opposing directions. Similarly, the driving area for each direction of travel may have multiple driving lanes thereon.

The series of depressions may be continuous or may have a skip pattern incorporated therein. Specifications may vary from state to state and even within a particular state. These specifications define overall size and depth of each depression as well as relative placement within the overall series, all within predefined ranges of accuracy.

One example of a set of specifications for a series of depressions, used herein only for illustration, has each depression having a rectangular shape at the surface of the road with a measurement of sixteen inches across and seven inches in length aligned with the driving lane. The series will be outside of the normal driving area, but in close proximity thereto. Due to the milling procedure employed, each depression will have an arced base from rearward trailing edge to forward leading edge with a depth of about five-eighths of an inch at the center portion. Numerous specifications require one (1) depression installed for each linear foot of surface. This results in an uncut section of surface between each adjacent pair of depressions of five inches. Therefore, the continuous series would result in the installation of fifty-two hundred and eighty (5280) depressions per mile. The skip pattern typically eliminates four (4) sequential installations within each grouping of twelve (12) normal installations. This results in an elimination of one-third (⅓) of the depressions present in the continuous series. Therefore, the skip pattern series would result in the installation of thirty-five hundred and twenty (3520) depressions per mile.

Without regard for the type of installation employed, continuous or skip, certain areas of the road will typically be excluded from the installation procedure. Examples of such areas include along bridges, along intersections, along entrance and exit ramps and adjacent motorist aid call boxes.

Numerous methods exist to install the series of depressions into the surface of the road. While it is possible to install the depressions using other methods, as exampled by stamping for asphalt, the following examples are specific to rotary cutting tools, as utilized by the present invention.

It has long been known to install the series using a repetitive series of advance, pause, plunge cut cycles utilizing a single cutting tool. This is an extremely inefficient method of installing the series and may result in a series having variation in spacing between each adjacent pair of depressions.

It is known to install the series using a similar pause while utilizing multiple cutting tools. Due to the dimensioning of the individual depressions it is not possible to position adjacent cutting tools in such a position to install two (2) adjacent depressions which have the proper spacing therebetween. Therefore, utilizing such machines having three (3) or more cutting tools it is common to have two (2) separate and distinct advancement cycles. One of the advancement cycles will be equal to the spacing of adjacent depressions within the resultant series. The second will be of a measurement to clear those depressions formed by the prior two (2) installation cycles. This method also is extremely inefficient and may result in a series having variation in spacing between each adjacent pair of depressions.

A recent innovation in the installation of the series of depressions has been to eliminate the previously required pause of the installation machine. This allows for continuous advance of the installation machine with the milling procedure mechanically regulated. It is conventionally known to regulate a lowering action and a raising action of the cutting tool during the advance to provide for the desired spacing between installations as well as the proper dimensioning of the depressions.

One of applicants prior patents disclose the use of multiple cutting tools to form the desired series wherein the machine may be continuously advanced.

Various deficiencies exist with the conventionally known methods of installing series of depressions. These deficiencies reside primarily in limitations of installation speed of the known installation machines.

Various attempts have been made to provide for an installation machine capable of installing depressions in a series wherein the installation time exceeded that of the then known convention installation machines. These attempts have been less efficient than desired due to the conventional requirement that each depression be completely formed by the milling action of a single cutting tool. As such, it may be appreciated that there continues to be a need for an installation machine which may exceed the installation speed of conventionally known installation machines while maintaining tight tolerances existing within a respective set of specification for the resultant series. The present invention substantially fulfills these needs.

SUMMARY

In view of the foregoing disadvantages inherent in the known methods of installing depressions into a surface of a road, your applicants have devised a method of milling to form a finished depression into the surface of the road at a select positional placement location using a sequential cooperation between respective milling actions of at least two cutting tools. The method comprises the steps of providing a depression installation machine, providing cutting tool elevational height adjustment means and providing positional control means. The depression installation machine comprises a first cutting tool and at least one additional cutting tool. The first cutting tool provides for a first milling action to mill the surface of the road to remove a first amount of a road material at the select positional placement location. Each additional cutting tool provides for a subsequent milling action to mill the road to remove a subsequent amount of the road material at the select positional placement location. The cutting tool elevational height adjustment means provides for an altering of an elevational height of each respective cutting tool relative to the surface of the road. This altering of the elevational height resulting in a respective milling action by the respective cutting tool. The positional control means providing for a sequential positioning of the respective cutting tools where the respective milling actions occur at the select positional placement location to provide for the sequential cooperation to form the finished depression at the select positional placement location.

Our invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for the use of at least two (2) cutting tools where the distinct milling actions of the respective cutting tools cooperate to form a single depression.

Other objects include;

a) to provide for alternating milling actions by the respective cutting tools to reduce or eliminate installation operating time when a distinct milling action is not occurring.

b) to provide for reducing rotation resistance on each respective cutting tool during the respective milling action by reducing the material milled by the respective milling action compared to the amount required by a single milling action to form a finished depression.

c) to provide for a continuous advance of a depression installation machine during an installation procedure wherein a plurality of depressions are installed.

d) to provide for uniform power consumption, within a narrow tolerance range, by a depression installation machine by providing for an adequate number of cutting tools and tight control over respective milling cycles wherein a relatively consistent cooperative milling action is produced collectively by all deployed cutting tools during an installation procedure of a continuous series of depressions.

e) to provide for a single cutting set of cutting tools which cooperate to form each depression within a series of depressions.

f) to provide for a first cutting set of cutting tools which cooperate to form each respective depression within a first subset of depressions and a second cutting set of cutting tools which cooperate to form each respective depression within a second subset of depressions wherein the first subset of depressions and the second subset of depressions form a series of depressions.

g) to provide for each cutting tool to remain relatively longitudinally fixed relative to the depression installation machine during each respective milling cycle during an installation procedure.

h) to provide for each cutting tool to be longitudinally oscillated on the depression installation machine during each respective installation cycle during an installation procedure wherein the respective cutting tool is retracted on the depression installation machine in an opposing direction to a direction of machine advance during at least a portion of a time span while a respective milling action is occurring during the installation cycle and advanced on the depression installation machine in the direction of machine advance during at least a portion of a time span while the milling action is not occurring during the installation cycle.

i) to provide for installation cycles of lowerings and raisings of each respective cutting tool to be regulated by a road engaging eccentric wheel having at least one camming group contained thereon.

j) to provide for installation cycles of lowerings and raisings of each respective cutting tool to be regulated by a cam member having at least one camming group contained thereon, wherein the cam member is elevated above the road and rotating based on passage of a depression installation machine relative to the road.

k) to provide for installation cycles of lowerings and raisings of each respective cutting tool to be regulated by an electronic device wherein the electronic device receives input indicative of passage of a depression installation machine relative to the road.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DEFINITIONS

Figure 1:
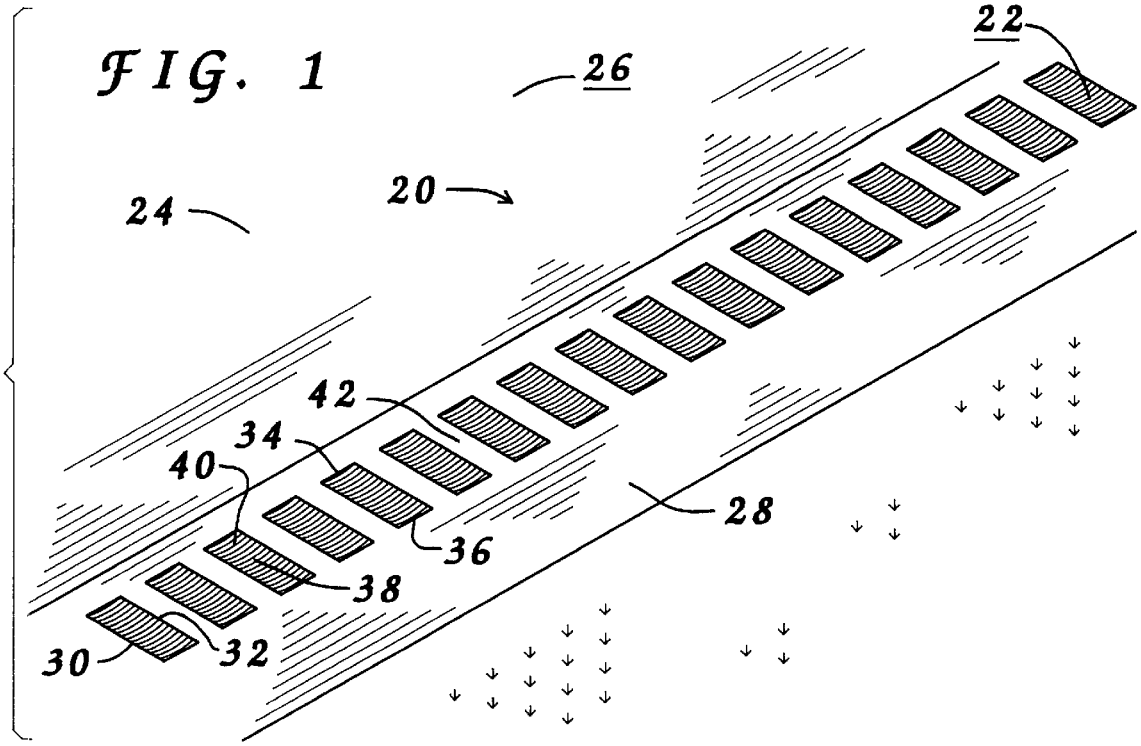
FIG. 1 is a perspective view of a continuous series of depression installed in a road.

Depression installation machine refers to any select embodiment of machine having features of the present invention which is capable of installing a depression.

Cutting tool refers to rotary milling drums capable of removing road material from a road.

Milling action refers to the actual milling of road material from the road using a cutting tool.

Milling cycle refers to movement of the cutting tool from any select point in the process through return to the same point in the process.

Installation cycle refers to a period of operation of the depression installation machine during which time each deployed cutting tool completes, or may complete if cycle blocking is employed, one (1) respective milling cycle.

Operating periods refers to distinct subgroup divisions of the installation cycle.

Cycle blocking refers to selective elimination of certain movement(s) of a respective cutting tool within a milling cycle to prevent select milling actions of the respective cutting tool from occurring.

Milling procedure refers to the totality of milling actions of multiple cutting tools to install a finished depression at a select positional placement location on the road.

Installation procedure refers to operation of the depression installation machine to install a plurality of finished depressions in a series of depressions and will involve a plurality of installation cycles.

DESCRIPTION

Reference is now made to the drawings where like reference numerals refer to like parts throughout the various views. Several embodiments of the present invention are illustrated in the various views. Series of depressions are illustrated as may be installed in a road by a machine having features of the present invention. Various cooperative milling steps, as may be performed under the present invention to install a depression, are illustrated. Conventional plunge and mill through milling procedures, identified as prior art, as may be performed to install a depression are illustrated for comparison to the present invention.

The present invention relates to installation, using a milling procedure, of a depression into a surface of a road. In practice, such depressions are installed in a series. A particular series may be continuous or have a skip pattern incorporated therein.

Series of Depressions

FIG. 1 depicts a continuous series 20 of depressions 22 installed in a surface 24 of a road 26. Surface 24 defines a grade 28 around each depression 22. Each depression 22 has a forward leading edge 30, a rearward trailing edge 32, an outer side edge 34, an inner side edge 36 and a base 38. Base 38 is transitional, or tapered, from rearward trailing edge 32 and forward leading edge 30 to a lateral maximum depth 40 which extends laterally across depression 22. Each depression 22 is formed by removal, by a milling procedure, of an amount of road material from road 26. The road material normally will be asphalt but may be concrete or other suitable roadway construction material. Each adjacent pair of depressions 22 within continuous series 20 is separated by an untreated area 42 of surface 24. Continuous series 20 has each adjacent pair of depressions 22, within predefined tolerances, uniformly spaced and aligned.

Figure 2:
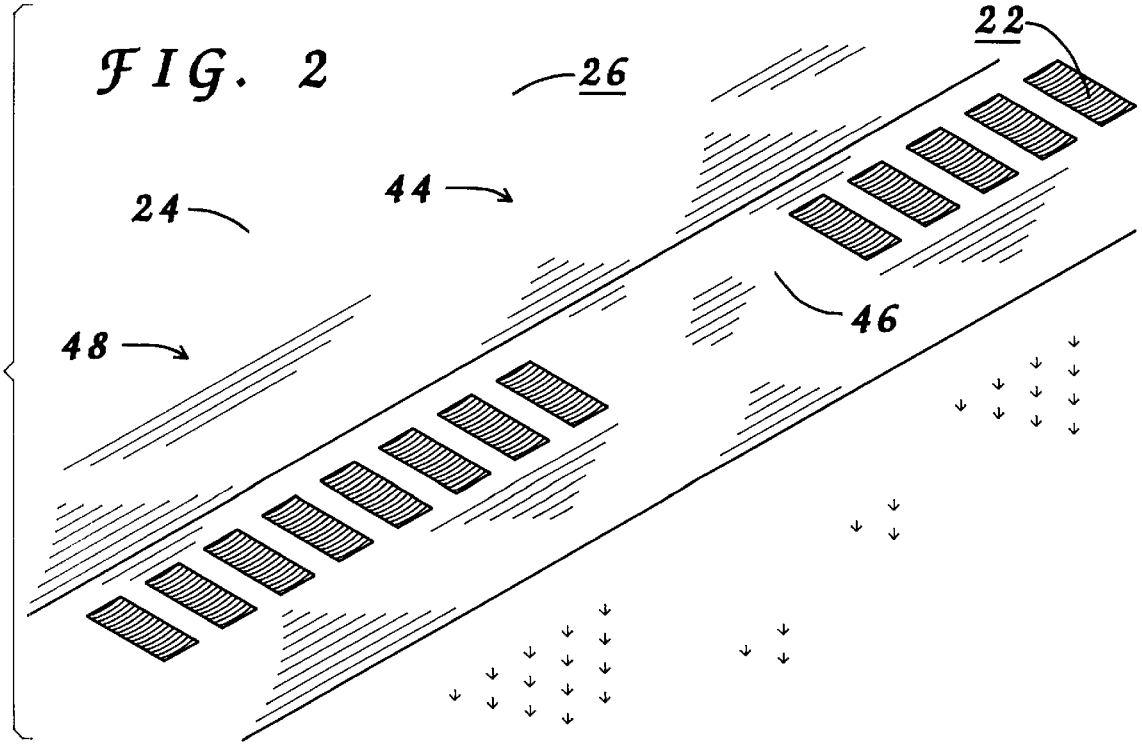
FIG. 2 is a perspective view of a skip series of depressions installed in the road.
Figure 3A:
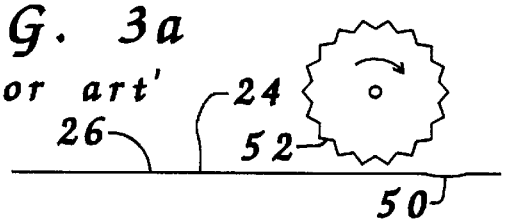
FIG. 3*a* through FIG. 3*g* are elevational depictions of 'prior art' milling of a depression using a plunge cut.
Figure 3B:
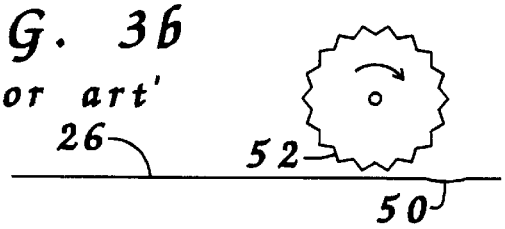
Figure 3C:
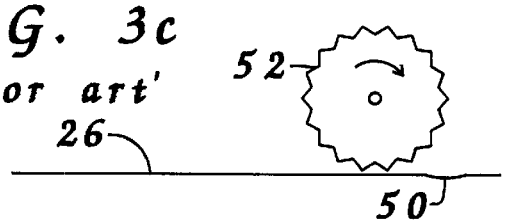
Figure 3D:
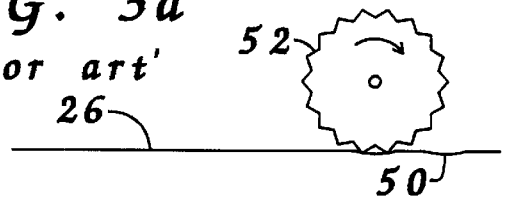
Figure 3E:
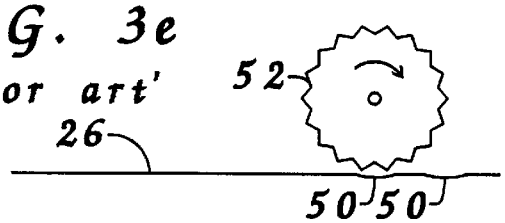
Figure 3F:
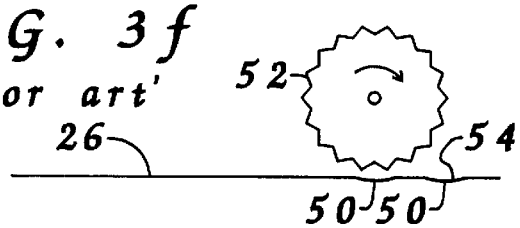
Figure 3G:
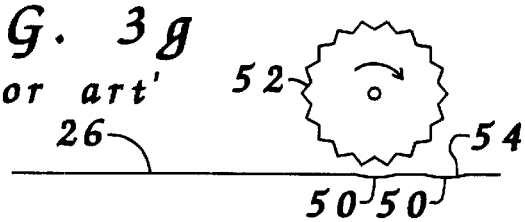
Figure 4A:
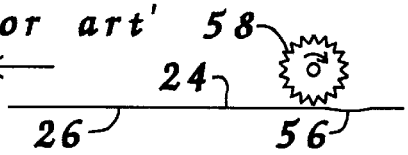
FIG. 4*a* through FIG. 4*g* are elevational depictions of 'prior art' milling of a depression using a mill through cut.
Figure 4B:
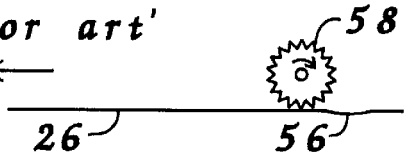
Figure 4C:
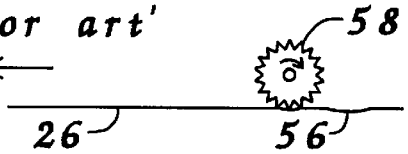
Figure 4D:
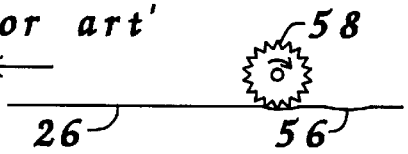
Figure 4E:
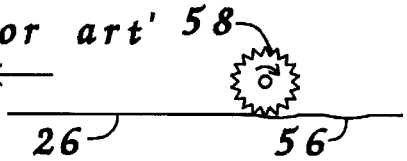
Figure 4F:
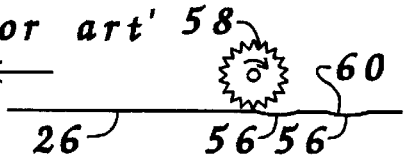
Figure 4G:
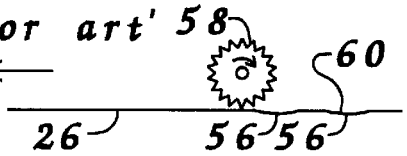

FIG. 2 depicts a skip pattern series 44 of depressions 22 installed in surface 24 of road 26. Skip pattern series 44 is installed in select groups with a skip areas 46 incorporated therein. An installed group 48 has eight (8) depressions 22 installed therein adjacent to skip area 46 covering an area equal to the normal installation of four (4) depressions 22. This pattern results in the elimination of one-third of the installations of continuous series 20, shown in FIG. 1.

Prior Art Milling Action

FIG. 3*a* through FIG. 3*g*, each identified as 'Prior Art', illustrate a conventionally known method of milling to form a depression 50 using a plunge cut type of installation. A cutting tool 52 is depicted positioned above surface 24 of road 26. Plunge cut type installations require that there be very little advancing motion, and preferably a complete absence of advancing motion, of cutting tool 52 while in contact with road 26. This type of installation results in depression 50 having a radially shaped base 54 matching, or nearly matching, the diameter of cutting tool 52. A single milling action, performed solely by cutting tool 52, and performed without interruption, forms depression 50 into road 26. In order to install a series of depressions 50 it is necessary to advance cutting tool 52 along road 26 to the next position of installation.

FIG. 4*a* through FIG. 4*g*, each identified as 'Prior Art', illustrate a conventionally known method of milling to form a depression 56 using a mill through type of installation. A cutting tool 58 is depicted positioned above surface 24 of road 26. Mill through type installations require that there be significant advancing motion of cutting tool 58 while in contact with road 26. This type of installation results in depression 56 having a radially shaped base 60 which has a diametric measurement significantly greater than the diameter of cutting tool 58. A single milling action, performed solely by cutting tool 58, and performed without interruption, forms depression 56 into road 26. In order to install a series of depressions 56 it is necessary to advance cutting tool 58 along road 26 to the next position of installation.

Present Invention Milling Action

It is possible to utilize the present invention while employing a depression installation machine which uses a series of pauses of advance during the installation procedure. Preferably, the depression installation machine is in a state of continuous advance during the installation procedure.

Figure 5A:
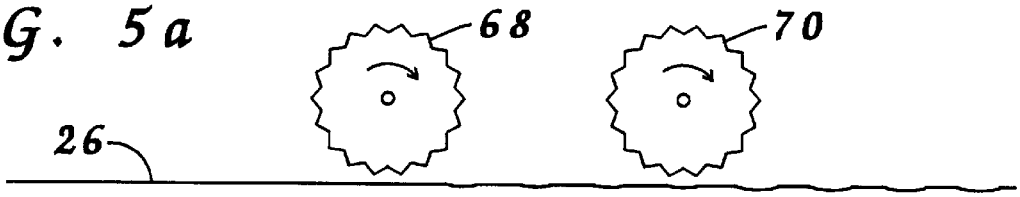
FIG. 5*a* through FIG. 5*c* are elevational depictions of milling using the principles of the present invention to form a depression using a plunge cut.
Figure 5B:
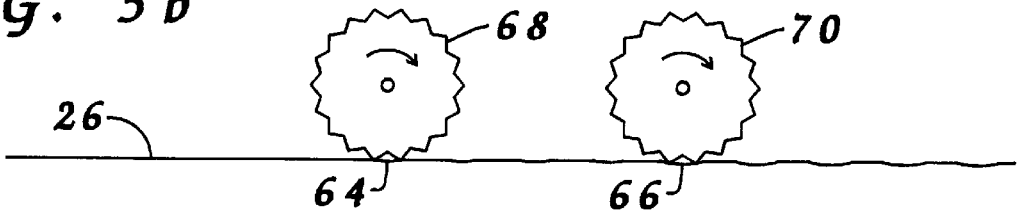
Figure 5C:
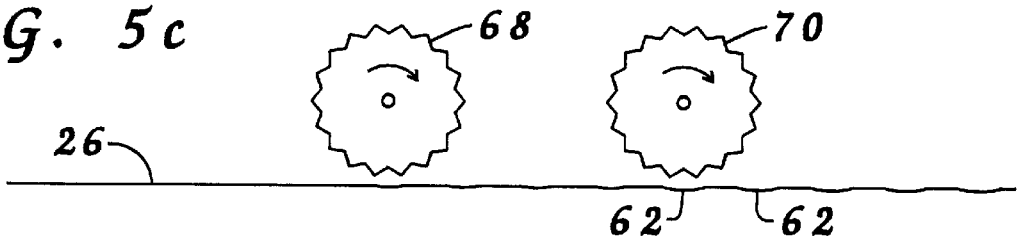

FIG. 5*a* through FIG. 5*c* depict formation of a depression 62, see FIG. 5*c*, as formed by a cooperation between a milling action 64 and a milling action 66, see FIG. 5*b*. A first cutting tool 68 performs milling action 64 while a second cutting tool 70 performs milling action 66. Milling actions 64 and 66 are plunge cuts where there exist little or no forward advance of cutting tool 68 and 70 while in respective contact with road 26. Milling action 64 does not penetrate road 26 to the depth that milling action 66 does. Milling action 66, performed subsequently to milling action 64, but in the same positional location as milling action 64, acts to complete depression 62. While it is possible to make a plunge cut wherein the respective cutting tool is longitudinally fixed to the depression installation machine, preferably, such a cut is made utilizing cutting tool displacement as explained elsewhere herein.

Figure 6A:
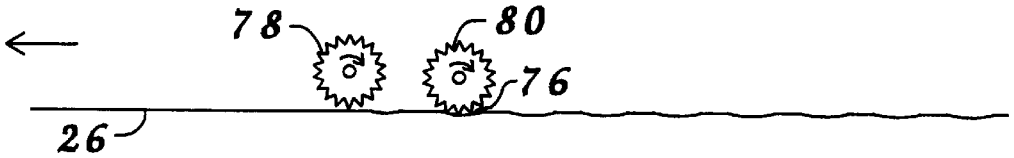
FIG. 6*a* through FIG. 6*c* are elevational depictions of milling using the principles of the present invention to form a depression using a mill through cut.
Figure 6B:
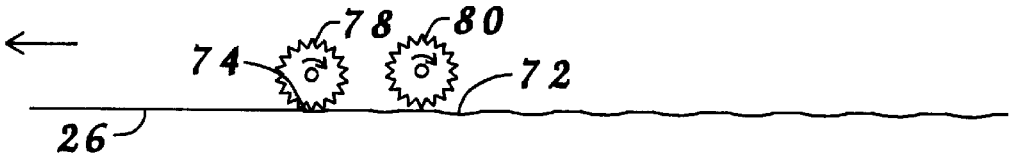
Figure 6C:
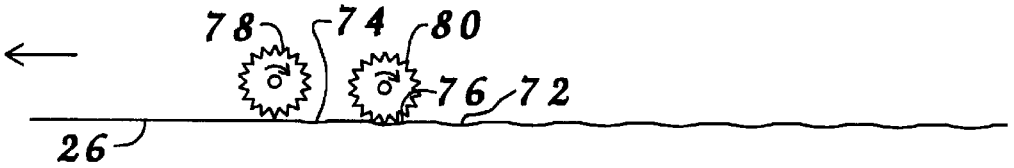

FIG. 6*a* through FIG. 6*c* depict formation of a depression 72, see FIG. 6*b*, as formed by a cooperation between a milling action 74, see FIG. 6*b* for performance of one (1) milling action 74, and milling action 76, see FIG. 6*a* and FIG. 6*c*. A first cutting tool 78 performs milling action 74 while a second cutting tool 80 performs milling action 76. Milling actions 74 and 76 are mill through cuts where there exist a significant measurement of forward advance of cutting tool 78 and 80 while in respective contact with road 26. Milling action 74 does not penetrate road 26 to the depth that milling action 76 does. Milling action 76, performed subsequently to milling action 74, but in the same positional location as milling action 74, acts to complete depression 72.

There exist two (2) general measurement methods for determining the elevational displacement of each of the respective cutting tools. The first method involves attempting to mill a quantity of road material which is generally equal for each of the respective cooperating cutting tools. This involves calculating the amount of road material displaced by the finished depression and then calculating the depth that each sequential cutting tool must obtain to equal the proper fraction thereof, depending upon the number of cooperating cutting tools. The second method involves determining the desired depth of the finished depression and then sequentially milling to the fractional depth required, again depending upon the number of cooperating cutting tools.

Figure 7A:
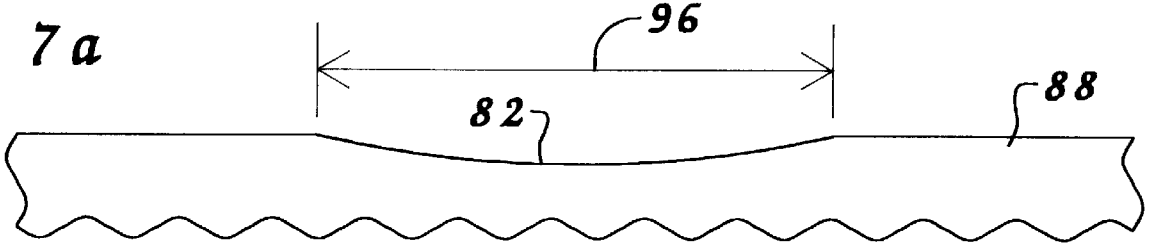
FIG. 7*a* and FIG. 7*b* are elevational depictions of formation of a depression using a cooperation between two (2) milling actions.
Figure 7B:
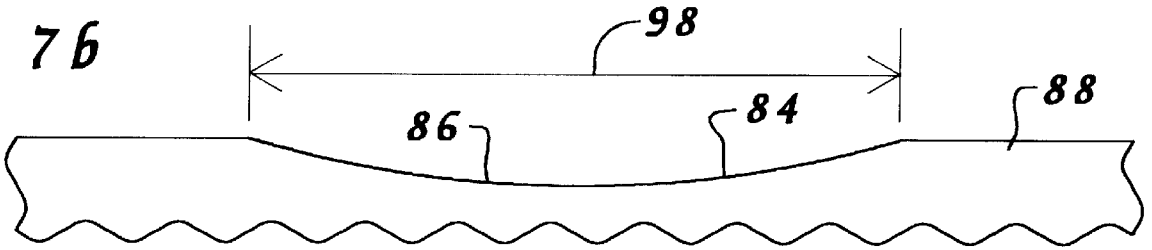

FIG. 7*a* depicts a first milled depression 82 as may be installed by a first cutting tool, not shown in these views. FIG. 7*b* depicts a second milled depression 84 as may be installed by a second cutting tool, not shown in these views, by a milling action performed at the same location as a previously installed first milled depression 82, as shown in FIG. 7*a*. The cooperation between these two (2) milling actions at the same positional location forms a depression 86, shown in FIG. 7*b*. Control over the amount of a road material 88 removed by each milling action allows for the first method of determining the elevational displacement of each of the respective cutting tools wherein approximately equal quantities of road material 88 are removed by each of the milling actions.

Figure 8A:
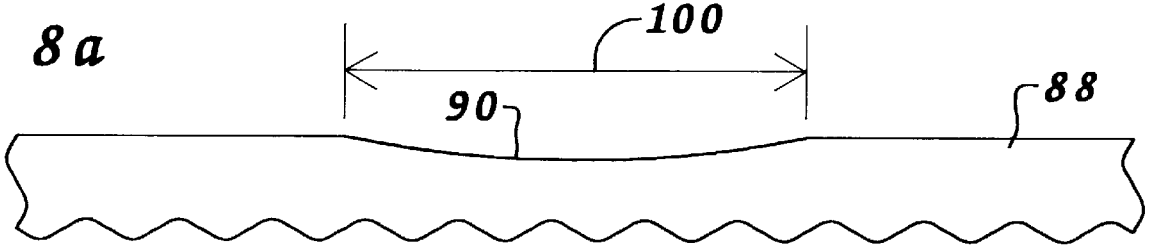
FIG. 8*a* and FIG. 8*b* are elevational depictions of a second embodiment of formation of a depression using a cooperation between two (2) milling actions.
Figure 8B:
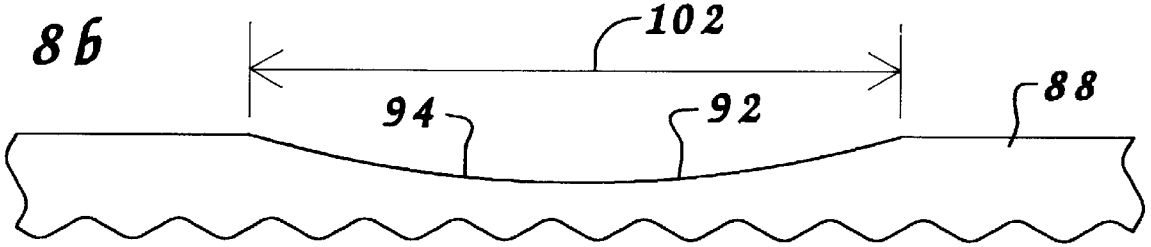

FIG. 8*a* depicts a first milled depression 90 as may be installed by a first cutting tool, not shown in these views. FIG. 8*b* depicts a second milled depression 92 as may be installed by a second cutting tool, not shown in these views, by a milling action performed at the same location as a previously installed first milled depression 90, as shown in FIG. 8*a*. The cooperation between these two (2) milling actions at the same positional location forms a depression 94, shown in FIG. 7*b*. Control over the amount of road material 88 removed by each milling action allows for the second method of determining the elevational displacement of each of the respective cutting tools wherein approximately equal milling depths are obtained within road material 88 as measured at the center of the respective milled depression 90 and 92.

FIG. 7*a* depicts a width of cut 96 as results from the milling action which forms first milled depression 82. FIG. 7*b* depicts a width of cut 98 as results from the milling action which forms second milled depression 84, which is depression 86 as formed by the cooperation between the two (2) milling actions. FIG. 8*a* depicts a width of cut 100 as results from the milling action which forms first milled depression 90. FIG. 8*b* depicts a width of cut 102 as results from the milling action which forms second milled depression 92, which is depression 94 as formed by the cooperation between the two (2) milling actions. It is noted that width of cut 96, which results from uniform removal of material method, is greater than width of cut 100, which results from uniform penetration depth method.

Elevational Height Regulation Means

Various methods exist to provide for the desired elevational height regulation of each respective cutting tool deployed on a depression installation machine having features of the present invention. Ideally, the depression installation machine is continuously advancing along the road during an installation procedure and preferably continuously advancing at an even and consistent pace. Therefore, it is a requirement when continuous advance is employed that the elevation height regulation of each respective cutting tool be controlled by a measurement of passage of the depression installation machine along the road. Even when the depression installation machine's advance is stop during the milling action, it is a requirement that a proper measurement of advance occur between each subsequent pause of advance.

The following three methods, and the specific examples given, of elevational height regulation are intended to explain variations and should not be viewed as being all inclusive. The first method involves providing an eccentric ground engaging wheel which, through structural elements, physically manipulate other structures which directly cause elevational changes to a respective cutting tool. The second method involves providing a cam member mounted on the depression installation machine above the road, but being powered to rotate based on passage of a ground engaging wheel of the depression installation machine along the road. The third method involves providing electronic control which receives input indicative of travel of the depression installation machine along the road.

The first method has distinct advantages in that it is simple to implement in practice, will accurately measure surface distance due to the fixed circumference of the wheel, may have a single camming group or may have multiple camming groups and may be perfectly round with an offset axle or may have an irregular shape with the camming groups implemented be the surface changes. Additionally, if desired, an eccentric wheel may be employed for each deployed cutting tool with linkage to maintain synchronized rotation of the various eccentric wheels.

Figure 9A:
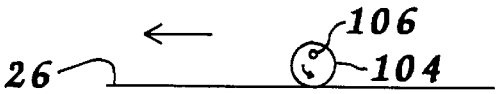
FIG. 9*a* through FIG. 9*c* are elevational depictions of an eccentric wheel in various positional orientations during movement along the road.
Figure 9B:
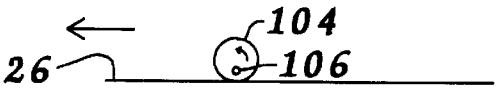
Figure 9C:
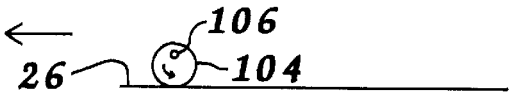

FIG. 9*a* through FIG. 9*c* depict an eccentric wheel 104 capable of providing control over at least one (1) cutting tool, not shown in these views, while moving along road 26. Eccentric wheel 104 has an axle 106 which is elevationally moved during rotation of eccentric wheel 104. Axle 106 would support, directly or indirectly, at least a portion of the cutting tool. It is noted that while eccentric wheel 104 provides for a single camming action during each rotation, multiple camming actions are possible during each complete rotation of the wheel by increasing the size and number of camming groups thereon.

The second method shares many of the advantages of the eccentric wheel, which is ground engaging, and further includes the advantages of being capable of having variation in the measurement of its physical circumference due to the capability, through intermediate gearing, of varying the rotation speed relative to the originating ground engaging wheel. Similarly, it is possible to provide a single cam member for each deployed cutting tool.

Figure 10A:
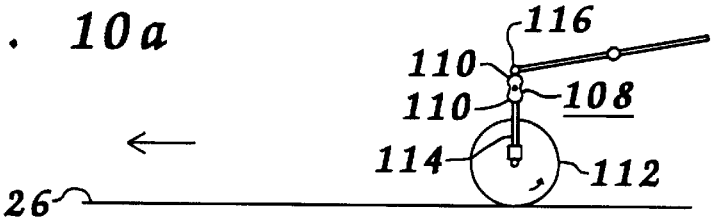
FIG. 10*a* through FIG. 10*c* are elevational depictions of a cam member in various positional orientations during movement along the road.
Figure 10B:
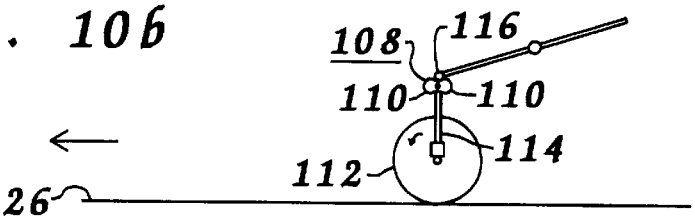
Figure 10C:
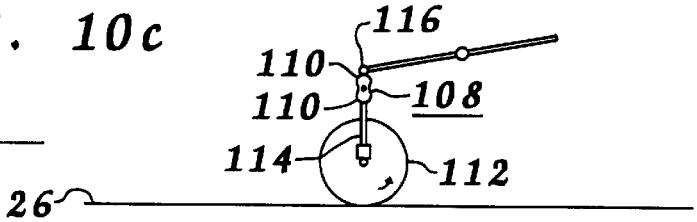

FIG. 10*a* through FIG. 10*c* depict a cam member 108, having two (2) camming groups 110, which is mounted on a depression installation machine, not shown in these views, above road 26. A ground engaging wheel 112 provides for transfer of rotational power to cam member 108 using a linkage 114. A rider 116 contacts cam member 108 and, in turn, transfers elevational changes from each camming group 110 to a cutting tool, not shown in these views.

The third method share many of the advantages of the prior two methods and further includes the ability to provide electronic control over the select milling cycles which make cycle blocking, described elsewhere herein, easy to implement. The input indicative of travel of the depression installation machine may be generated at a ground engaging wheel or may be generated by at least one sensor wherein the sensor is capable of measuring travel distance without physical contact, directly or indirectly, with the road.

Figure 11A:
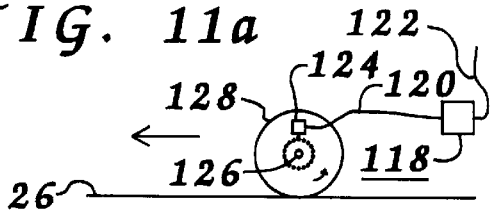
FIG. 11*a* through FIG. 11*c* are elevational depictions of an electronic control panel receiving input from rotation of a wheel along the road.
Figure 11B:
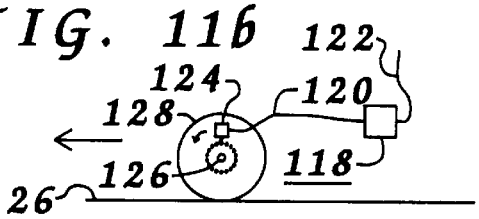
Figure 11C:
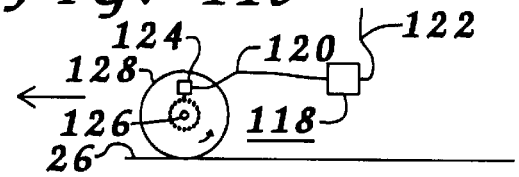

FIG. 11*a* through FIG. 11*c* depict an electronic control panel 118 which receives input from a lead 120 and transfers an output using a lead 122. Input from lead 120 is produced by a measuring device 124 attached to an axle 126 which supports a wheel 128 which contacts road 26 and, therefore, the input is indicative of rotation of wheel 128 along road 26. As conventionally known in the art, electronic control panel is capable of making computational calculations and producing desired electronic signals thereon. Output from electronic control panel 118, based on these computational calculations, are sent by lead 122 to a control element, not shown, which in turn act to regulate the elevational height of a cutting tool, also not shown. The control element may be of any suitable structure as exampled by a hydraulic drive.

Installation Procedure

Depending upon the spacing of the respective cutting tools, it may be necessary to provide for cycle blocking at the beginning and/or end of each installation procedure. (Installation procedure may involve a continuous series or may be considered to be related to each distinct grouping of continuous depression within a skip series.) The follow example depicts use of two (2) cutting tools which cooperate to install each depression within the series using alternating cycling where the milling actions occur on a differing schedule. Numerous combinations exist including the number of cutting tools, the number of cutting tool set, (explained elsewhere herein), and the relative spacing between deployed cutting tools. The following is used only to explain the principle of cooperation between milling actions of multiple cutting tools to form depressions.

FIG. 12*a* through FIG. 12*e* depict a depression installation machine 130, having a first cutting tool 132 and a second cutting tool 134, positioned in various operating orientations on road 26 during an installation procedure 136. Depression installation machine 130 will operate in a series of installation cycles 138, two (2) installation cycles 138 depicted in the series of views, (FIG. 12*a* through FIG. 12*c* and FIG. 12*c* through FIG. 12*e*). During each installation cycle 138 each respective cutting tool 132 and 134 will complete one (1) milling cycle 140 and 142 respectively. (Milling cycle 140 and milling cycle 142 begin at differing positional placement locations due to alternating cycling being employed.) During each installation cycle 138 each respective cutting tool 132 and 134 will move through their respective motions, (in the absence of cycle blocking), and return to their respective beginning points. Cycle blocking, in any of the various implementations, acts to selectively prevent cutting tool 132 or 134 from engaging road 26 in a milling action.

Milling cycle 140 of first cutting tool 132 begins at a transition point 144 between a raising motion, see FIG. 12*b* through FIG. 12*c* and FIG. 12*d* through FIG. 12*e*, (just completed in FIG. 12*a*), and a lowering motion, see FIG. 12*a* through FIG. 12*b* and FIG. 12*c* through FIG. 12*d*. Milling cycle 142 of second cutting tool 134 begins at a transition point 146 following a lowering motion, see FIG. 12*d* through FIG. 12*e*, (just completed in FIG. 12*e*).

Figure 12A:
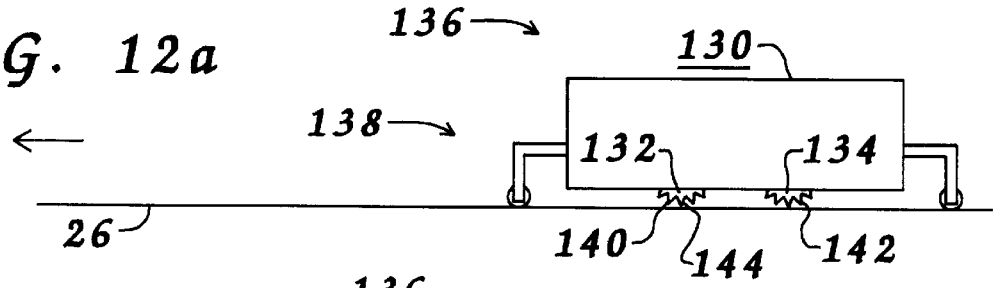
FIG. 12*a* through FIG. 12*e* are elevational depictions of a depression installation machine in various operational orientations along the road.
Figure 12B:
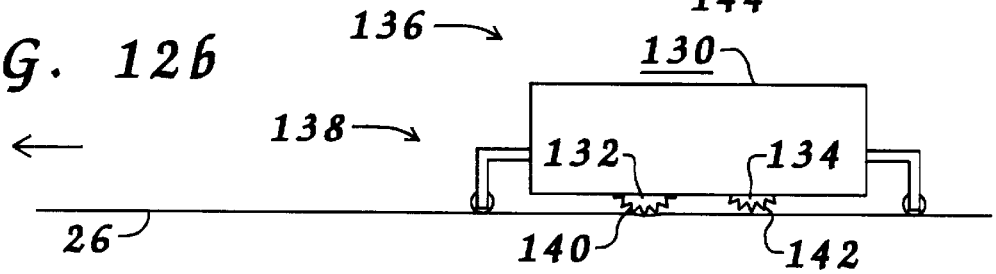
Figure 12C:
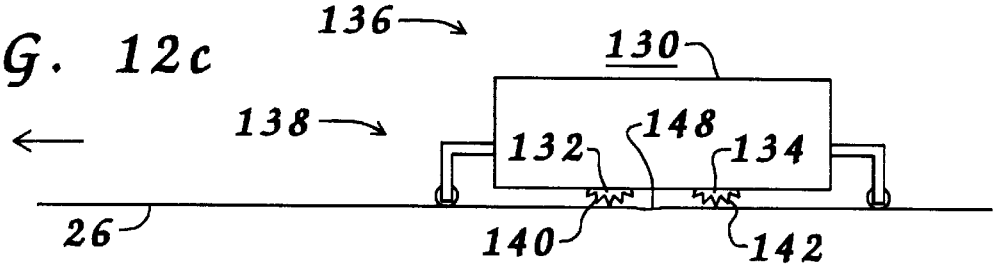
Figure 12D:
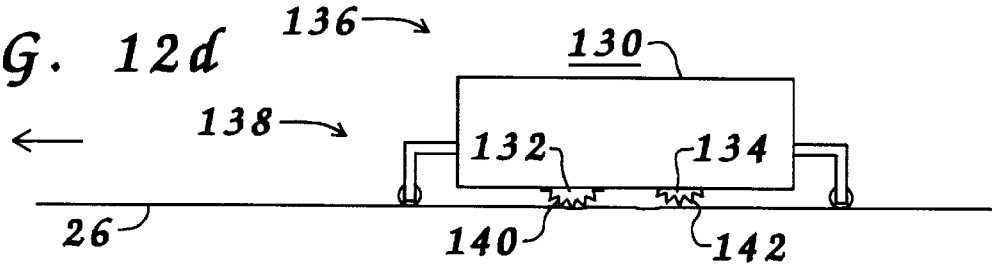
Figure 12E:
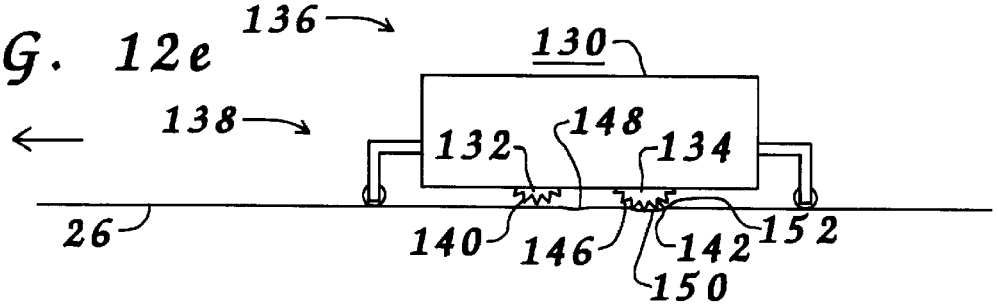
Figure 13A:
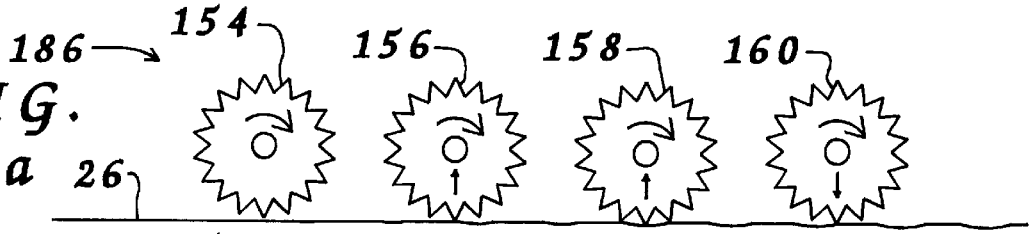
FIG. 13*a* through FIG. 13*m* are elevational depictions of positioning orientations of various cutting tools along the road during an installation cycle.
Figure 13B:
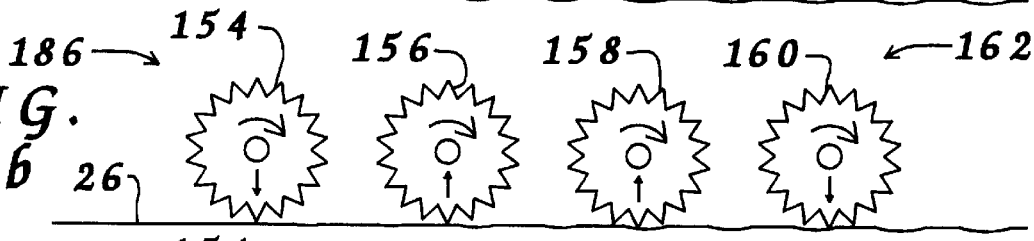
Figure 13C:
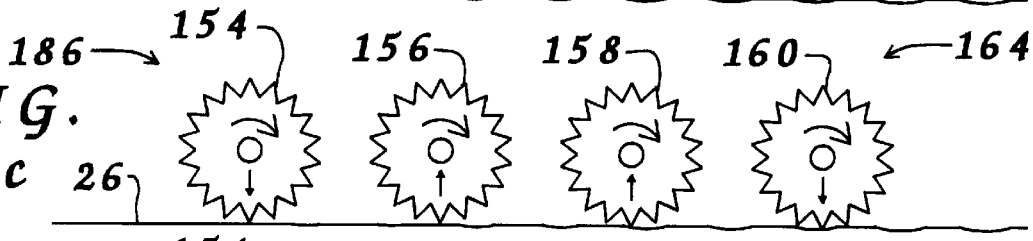
Figure 13D:
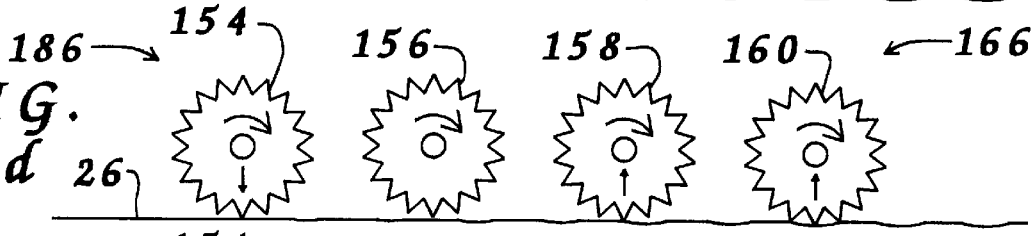
Figure 13E:
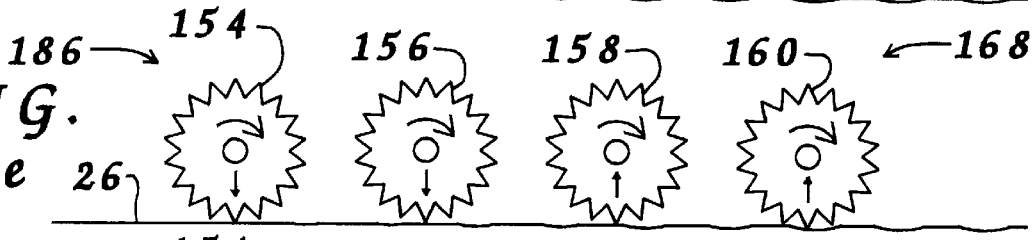
Figure 13F:
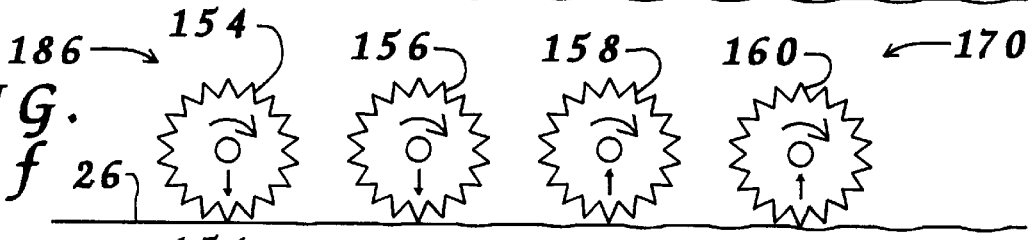
Figure 13G:
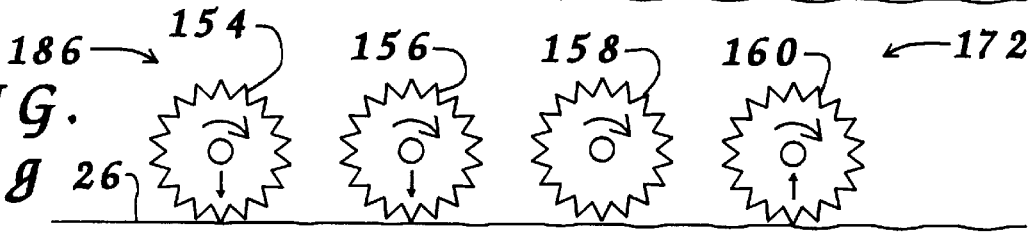
Figure 13H:
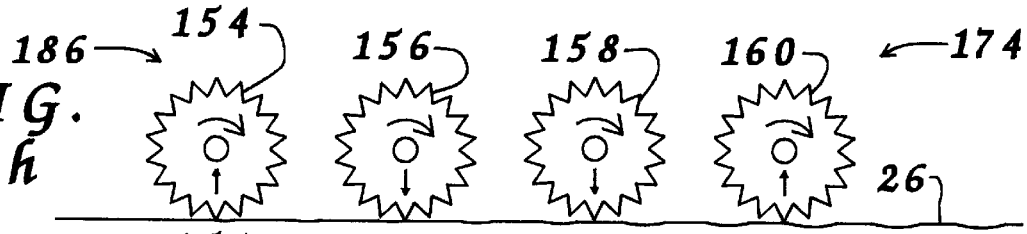
Figure 13I:
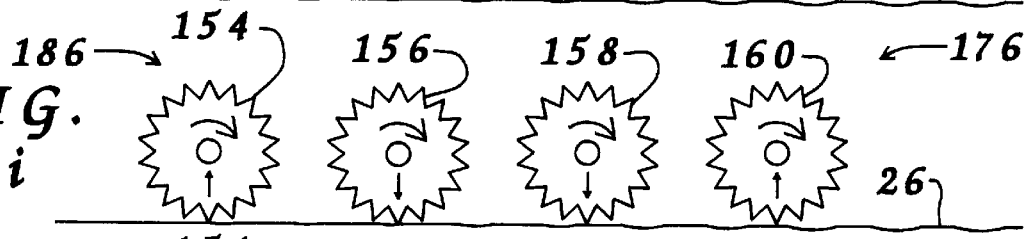
Figure 13J:
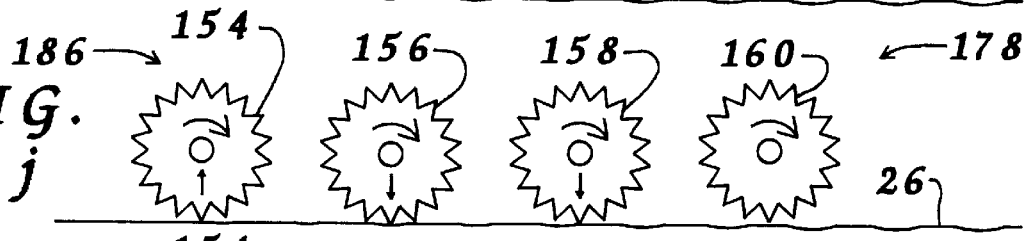
Figure 13K:
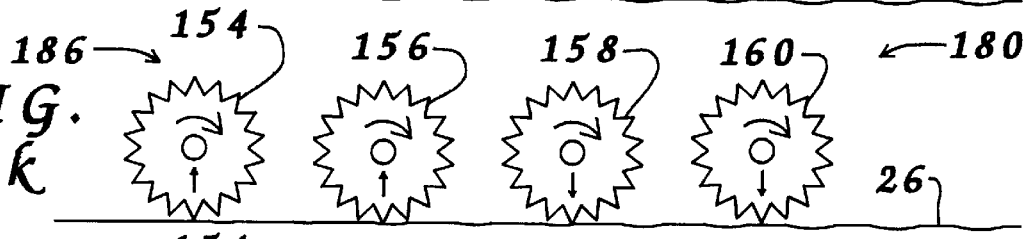
Figure 13L:
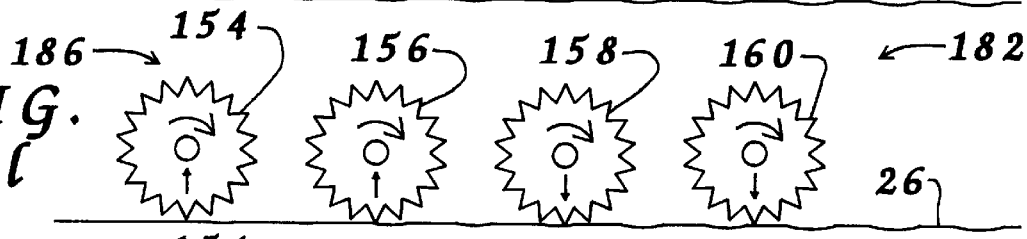
Figure 13M:
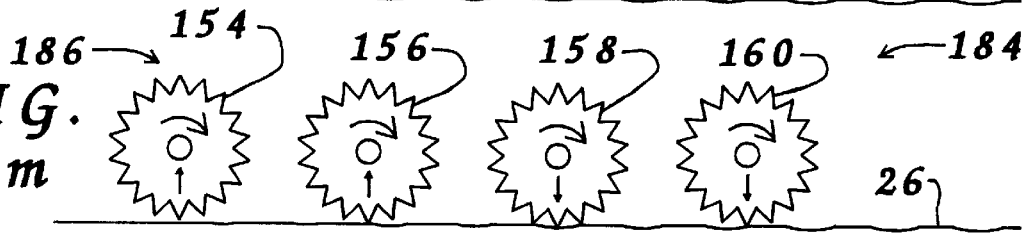

These views depict the beginning of installation procedure 136 and therefore, due to the spacing between first cutting tool 132 and second cutting tool 134 it is a requirement that the milling action of second cutting tool 134 be eliminated, (as first cutting tool 132 has not previously made a first cut 148, see FIG. 12*c*, at the positional placement location where the milling action of second cutting tool 134 would occur to install a second cut 150, see FIG. 12*e*, in the absence of cycle blocking). Therefore, structure, not shown, on depression installation machine 130 prevents second cutting tool 134 from contacting road 26 at this point, see FIG. 12*a* and FIG. 12*c*. Cycle blocking will similarly be required for first cutting tool 132 at the completion of installation procedure 136, not shown in these views. First cut 148, see FIG. 12*c*, cooperate with second cut 150, see FIG. 12*e*, to form a depression 152, see FIG. 12*e*.

Multiple Cutting Tool Sets

It may be desired to have multiple cutting tool sets wherein each respective cutting tool set cooperates to install a select subgroup of depressions within the overall series of depressions, as exampled by every other depression when two (2) cutting tool sets are employed. Cycle blocking will be required to install series of depressions utilizing such designs. This type of design is particularly efficient when cutting tool displacement, described elsewhere herein, is employed.

Operating Periods

Each installation procedure of a continuous series of depressions may be defined by a plurality of installation cycles wherein each respective cutting tool moves, or would normally move, if cycle blocking is employed, through a complete respective milling cycle. When the preferred alternating cycling is employed, each cutting tool will have a distinct beginning point within each definable installation cycle. The installation cycle may be arbitrarily defined using any desired beginning operational point during the installation procedure. The example which follows uses a beginning definable point for each installation cycle which is a transition point for the forward most cutting tool which defines the transition from being raised to being lowered. Following completion of each installation cycle this, (forward most), cutting tool is returned to this transition point. At the beginning of these installation cycles the other deployed cutting tools are at distinct points within their respective milling cycles and return to these respective points following completion of each installation cycle.

In a preferred embodiment, the depression installation machine is operating, within installation of a continuous series, with an extremely uniform power demand being made by all of the deployed cutting tools, to a tight tolerance, during each installation cycle. This provides for an efficient installation procedure utilizing a specific power generating system.

Each installation cycle of the depression installation machine may be further arbitrarily divided into a series of defined operating periods. Each cutting tool may, due to the differing requirements within the respective milling cycles and the differing requirements of the respective milling actions on the resultant depression, have a unique average measurement of rotation resistance during each of these defined operating periods. It is a desire, under a preferred embodiment of the present invention, that the total measurement of rotation resistance of all of the cutting tools deployed be relatively equal during each of the defined operating periods. This provides for a depression installation machine to operate consistently at peak efficiency.

The example which follows, used only for illustration of the principle, depicts four (4) cutting tools cooperating to install each respective depression within the series. Each respective cutting tool has a definable power demand within each arbitrarily defined operating period.

FIG. 13*a* through FIG. 13*m* depict a series of views depicting various orientations of a cutting tool 154, a cutting tool 156, a cutting tool 158 and a cutting tool 160. Cutting tools 154, 156, 158 and 160 are positioned relative to road 26 while in first operating period 162 through twelfth operating period 184. (Each operating period 162 through 184 are depicted as the motion shown between a pair of views.) First operating period 162 through twelfth operating period 184 form a complete installation cycle 186. As can be readily seen, the respective power demands will increase while a milling action is occurring and will vary depending upon the contact area and depth of penetration of the respective cutting tool 154, 156, 158 or 160 relative to road 26.

Cutting tool 154 is in contact with road 26 during a substantial portion of operating periods 168, 170 and 172. Cutting tool 156 is in contact with road 26 during a substantial portion of operating periods 174, 176 and 178. Cutting tool 158 is in contact with road 26 during a substantial portion of operating periods 180, 182 and 184. Cutting tool 160 is in contact with road 26 during a substantial portion of operating periods 162, 164 and 166. Therefore, one (1) of the cutting tools 154, 156, 158 or 160 is in contact with road 26 during substantial portions of each operating period 162 through 184.

Cutting Tool Displacement

It is possible to increase the efficiency of a depression installation machine having features of the present invention by decreasing the time span that each respective cutting tool is not engaging in a milling action. This is easily accomplished by providing for cutting tool displacement means to oscillate each respective cutting tool on the depression installation machine during a respective milling cycle. During at least a portion of the time that each respective milling action is occurring the respective cutting tool would be displaced in the opposing direction of travel of the depression installation machine. During at least a portion of the time that each respective milling action is not occurring the respective cutting tool would be displaced in the direction of travel of the depression installation machine. These actions would reduce the operating time while each respective cutting tool is not engaged in a milling action.

The principle objective of cutting tool displacement is to permit the machine to advance along the surface under treatment at a greater overall speed than would be possible with the cutting tools horizontally fixed to the machine. This is accomplished by increasing the time available for each respective cutting tool to be in contact with the surface and reducing the out of contact time for the respective cutting tool. Controlled horizontal displacement of each respective cutting tool rearward and forward along the machine permits the cutting tool to spend a greater percentage of a milling cycle in contact with the surface under treatment.

During retraction along the support frame the advance speed of the respective cutting tool relative to the surface under treatment is either slowed or stopped compared to the advance speed of the support frame. During this period the respective milling action of the respective cutting tool may occur. During advancement along the support frame the advance speed of the respective cutting tool relative to the surface under treatment is increased compared to the advance speed of the support frame. During this period the respective cutting tool is elevated above the surface under treatment.

Numerous structural configurations may provide for the controlled displacement of the cutting tools relative to the support frame. The only requirements for the structure providing this controlled displacement is that it be capable of moving the cutting tools along the support frame and that such movements be respectively regulated based on motion of the machine along the surface under treatment. Several examples of such structures include hydraulic drives, pneumatic drives, electric motors and direct transfer. When the structures are other than direct transfer, electronic transfer of signals indicative of passage along the surface under treatment may occur to provide control over the structures providing the horizontal displacement. Direct transfer is referring to transfer of power indicative of motion along the surface and may include supplemental power transfer as would result from power transfer controlled by the motion along the surface under treatment. Within the direct transfer of power, with or without supplemental power being added, several examples include chain drive, belt drive, rotation shaft transfer and rod gears.

Figure 14:
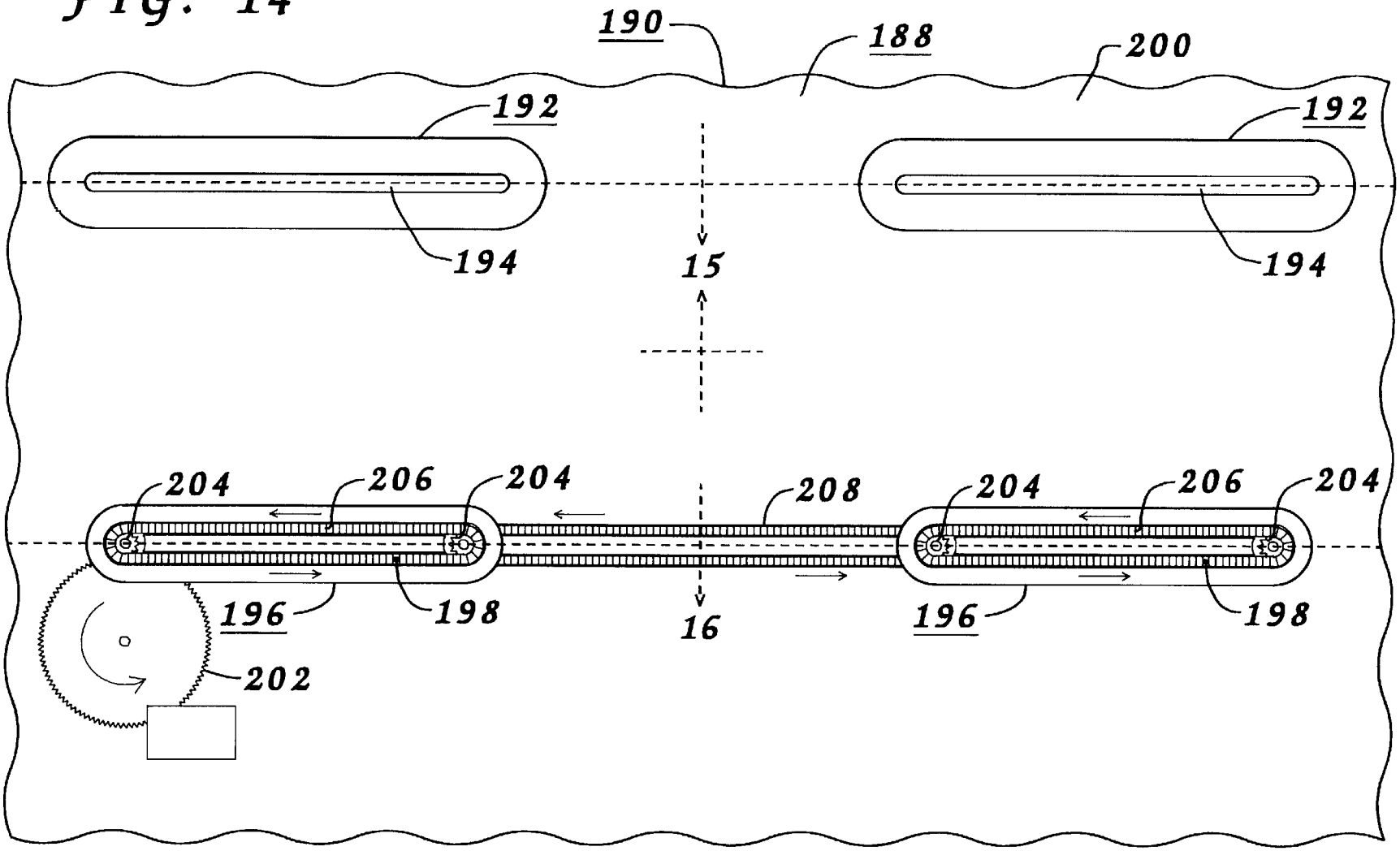
FIG. 14 is a sectional elevational view depicting a portion of a displacement assembly.
Figure 15:
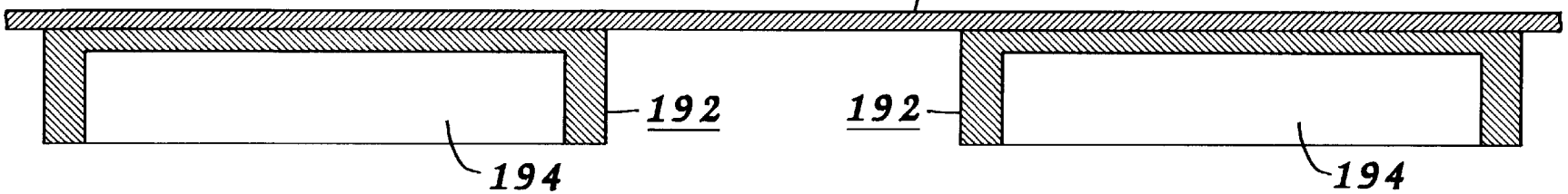
FIG. 15 is a sectional view as taken from the section lines '15' shown in FIG. 14.
Figure 16:
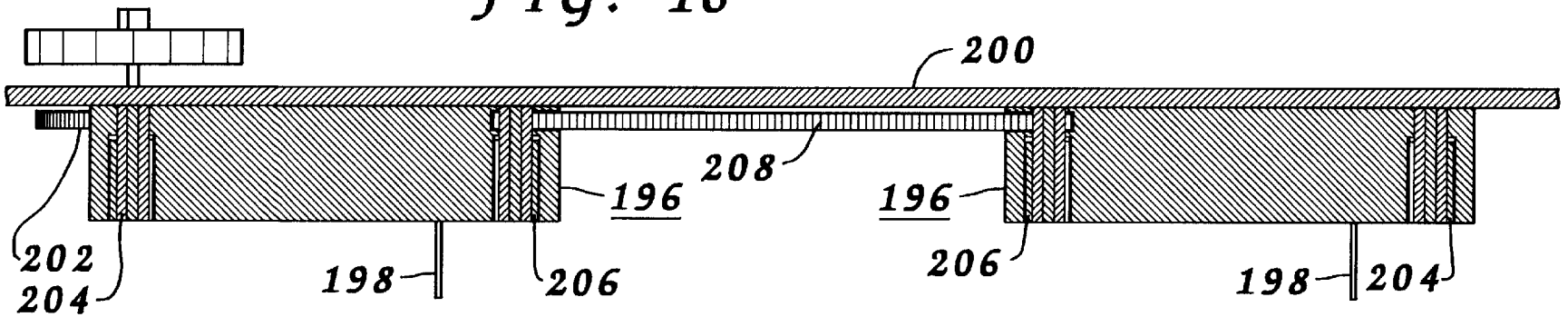
FIG. 16 is a sectional view as taken from the section line '16' shown in FIG. 14.

FIG. 14 through FIG. 16 depicts a portion of a depression installation machine 188 illustrating the principle of the desired cutting tool displacement means. Numerous other structural configurations will provide for the desired cutting tool displacement means.

FIG. 14 depicts one half of a displacement assembly 190. Two (2) drive supports 192 are shown each having a support slot 194. Two (2) longitudinal drives 196 are shown each having a longitudinal drive peg 198 extending therefrom. Each drive support 192 and the assembly comprised of the two (2) longitudinal drives 196 are secured to a housing side wall 200 utilizing any conventional method known in the art. Depression installation machine 188 will have two (2) opposing housing side walls 200 which each have attached thereto the above described grouping of two (2) drive supports 192 and the assembly comprised of two (2) longitudinal drives 196 in elevational relationship. Each deployed cutting tool, not shown in these views, may be supported by one (1) such displacement assembly 190.

Referring now specifically to FIG. 14 and FIG. 16 a gear 202 is caused to rotate based on the passage of depression installation machine 188 along the road, not shown in these views. Gear 202 communicates and transfers rotation to longitudinal drive 196. Longitudinal drive 196 has opposing drive gears 204 which cooperate to rotate a longitudinal drive chain 206 in an endless loop. Extending from longitudinal drive chain 206, and rigidly connected thereto, is longitudinal drive peg 198. A second longitudinal drive 196, having similar structure, is linked and synchronized to longitudinal drive 196 utilizing a coupling chain 208 such that two (2) longitudinal drive pegs 198 are synchronized and move in unison.

The gearing ratio, having been established, is such that the passage of one unit of measurement of depression installation machine 188 along the road is transferred to cause each longitudinal drive peg 198 to move longitudinally forward and rearward relative to a housing side wall 200 by an equal unit of measurement. Thus, during the rearward travel of longitudinal drive peg 198 a stationary elevated relative position is maintained relative to the road. This stationary positioning provides for a plunge cut to be made. Alternatively, it is possible to provide for a slowing of advance which provides for a mill through cut to be made.

In practice, one (1) cutting tool, not shown in these views, would be supported by each displacement assembly 190 utilizing extension pegs, not shown, extending from the cutting tool which, in turn, rest in a respective support slot 194. The physical mounting of extension pegs on the respective cutting tool would allow elevation height adjustment to allow for the milling action during the rearward transfer within displacement assembly 190. Longitudinal drive pegs 198 would mount within anchor slots, not shown, on the respective cutting tool to push the respective cutting tool along during each displacement cycle.

Numerous displacement assemblies are possible including those which rely upon direct transfer of elevational height regulation as possible with eccentric wheels or cam members.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method of milling to form a finished depression into a surface of a road at a select positional placement location using a sequential cooperation between respective milling actions of at least two cutting tools, the method of milling comprising the steps of:

a) providing a depression installation machine comprising:

1) a first cutting tool to provide for a first milling action to mill the surface of the road to remove a first amount of a road material at the select positional placement location;

2) at least one additional cutting tool, each additional cutting tool to provide for a subsequent milling action to mill the road to remove a subsequent amount of the road material at the select positional placement location;

b) providing cutting tool elevational height adjustment means to provide for an altering of an elevational height of each respective cutting tool relative to the surface of the road, the respective cutting tools being the first cutting tool and any additional cutting tools, the altering of the elevational height providing for a respective milling action of the respective cutting tools;

c) providing positional control means to provide for a sequential positioning of the respective cutting tools where the respective milling actions occur at the select positional placement location to provide for the sequential cooperation to form the finished depression at the select positional placement location;

whereby the depression milling machine forms the finished depression at the select positional placement location utilizing the sequential cooperation between the respective milling actions of the respective cutting tools.

2. The method of milling defined in claim 1 further comprising the step of repetitively forming finished depressions in a series of depressions, the series of depressions having a multiplicity of finished depressions generally aligned along a path.

3. The method of milling defined in claim 2:

a) wherein the first cutting tool has a series of lowered periods and a series of elevated periods, the lowered periods of the first cutting tool comprising periods of time while at least a portion of the first cutting tool is below a grade of the surface of the road, the elevated periods of the first cutting tool comprising periods of time while all of the first cutting tool is above the grade of the surface of the road;

b) wherein each additional cutting tool has a respective series of lowered periods and a respective series of elevated periods, the respective lowered periods of each additional cutting tool comprising periods of time while at least a portion of the respective additional cutting tool is below the grade of the surface of the road, the respective elevated periods of each additional cutting tool comprising periods of time while all of the respective additional cutting tool is above the grade of the surface of the road;

c) wherein the lowered periods of the first cutting tool and the respective lowered periods of each respective additional cutting tool occur on a differing schedule;

whereby the differing schedule of the lowered periods of the first cutting tool and the respective lowered periods of each respective additional cutting tool provide for optimization of efficiency of the method of milling.

4. The method of milling defined in claim 1 wherein the first amount of the road material removed by the first milling action of the first cutting tool and the subsequent amounts of the road material removed by any subsequent milling actions of any additional cutting tools are generally equal in quantity, whereby all respective milling actions mill the generally equal quantities of the road material to form the finished depression.

5. The method of milling defined in claim 1 wherein the respective cutting tools each have a cutting tool number in sequential order based on performance of the respective milling action and wherein the cutting tools have a cutting tool count equal to the number of cutting tools and wherein the finished depression further comprises a lateral maximum depth having a measurement from a plane formed by the surface of the road and wherein the sequential respective milling actions of the respective cutting tools each have a penetration depth below the plane formed by the surface of the road which is relatively equal to the lateral maximum depth divided by the cutting tool count multiplied by the cutting tool number whereby each respective milling action mill a generally equal depth sequentially to form the finished depression.

6. A method of milling to form a finished depression into a surface of a road at a select positional placement location using a cooperation between respective milling actions of at least two cutting tools, the method of milling comprising the steps of:

a) providing a depression installation machine comprising:

1) motion means to provide for moving the depression installation machine relative to the surface of the road;

2) a first cutting tool to provide for a first milling action to mill the surface of the road to remove a first amount of a road material at the select positional placement location;

3) at least one additional cutting tool, each additional cutting tool to provide for a subsequent milling action to mill the road to remove a subsequent amount of the road material at the select positional placement location, wherein a final milling action is produced by a final cutting tool, the final cutting tool being one of the additional cutting tools, the final milling action completing production of the finished depression;

b) providing elevational height adjustment means to provide for altering an elevational height of each respective cutting tool relative to the surface of the road, the respective cutting tools being the first cutting tool and any additional cutting tools, the elevational height adjustment means controlled by passage of at least a portion of the depression installation machine relative to the road;

c) providing penetration control means to provide for controlling a respective milling action of each respective cutting tool to mill a quantity of the road material of the road at the select positional placement location of the depression, the respective milling actions being the first milling action and any subsequent milling actions;

d) providing positional control means to provide for positioning the respective milling actions of the respective cutting tools at the select positional placement location to provide for the cooperation to form the finished depression at the select positional placement location of the depression;

wherein the depression milling machine moves relative to the surface of the road and forms the finished depression at the select positional placement location utilizing the cooperation between the respective milling actions of the respective cutting tools.

7. The method of milling defined in claim 6 further comprising the step of repetitively forming finished depressions in a series of depressions, the series of depressions having a multiplicity of finished depressions generally aligned along a path; and wherein the first cutting tool has a series of lowered periods and a series of elevated periods, the lowered periods of the first cutting tool comprising periods of time while at least a portion of the first cutting tool is below a grade of the surface of the road, the elevated periods of the first cutting tool comprising periods of time while all of the first cutting tool is above the grade of the surface of the road; and wherein each additional cutting tool has a respective series of lowered periods and a respective series of elevated periods, the respective lowered periods of each additional cutting tool comprising periods of time while at least a portion of the respective additional cutting tool is below the grade of the surface of the road, the respective elevated periods of each additional cutting tool comprising periods of time while all of the respective additional cutting tool is above the grade of the surface of the road; and wherein the lowered periods of the first cutting tool and the respective lowered periods of each respective additional cutting tool occur on a differing schedule, whereby the differing schedule of the lowered periods of the first cutting tool and the respective lowered periods of each respective additional cutting tool provide for optimization of efficiency of the method of milling.

8. The method of milling defined in claim 6 wherein the first amount of the road material removed by the first milling action of the first cutting tool and the subsequent amounts of the road material removed by any subsequent milling actions of any additional cutting tools are generally equal in quantity, whereby all respective milling actions mill the generally equal quantities of the road material to form the finished depression.

9. The method of milling defined in claim 6 wherein the respective cutting tools each have a cutting tool number in sequential order based on performance of the respective milling action and wherein the cutting tools have a cutting tool count equal to the number of cutting tools and wherein the finished depression further comprises a lateral maximum depth having a measurement from a plane formed by the surface of the road and wherein the sequential respective milling actions of the respective cutting tools each have a penetration depth below the plane formed by the surface of the road which is relatively equal to the lateral maximum depth divided by the cutting tool count multiplied by the cutting tool number whereby each respective milling action mill a generally equal depth sequentially to form the finished depression.

10. The method of milling defined in claim 6 wherein the depression installation machine further comprises cutting tool displacement means to provide for a movement of each respective cutting tool along the depression installation machine, the movement comprising a rearward transfer and a forward transfer, the movement to provide for each respective cutting tool to be displaced during a respective milling cycle of the respective cutting tool, the respective milling action of the respective cutting tool occurring during the rearward transfer of the respective cutting tool.

11. A depression installation machine to provide for forming a finished depression in a road wherein a plurality of cutting tools sequentially mill respective portions of a road material from the road to form the finished depression, the depression installation machine comprising:

a) motion means to provide for moving the depression installation machine relative to the road;

b) a first cutting tool to provide for a first milling action to mill the road at a select positional placement location to remove a first amount of the road material;

c) at least one additional cutting tool, each additional cutting tool to provide for a subsequent milling action to mill the road to remove a subsequent amount of the road material at the select positional placement location, wherein a final milling action is produced by a final cutting tool, the final cutting tool being one of the additional cutting tools, the final milling action completing production of the finished depression;

d) elevational height adjustment means to provide for altering an elevational height of each respective cutting tool relative to the surface of the road, the respective cutting tools being the first cutting tool and any additional cutting tools, the elevational height adjustment means controlled by passage of at least a portion of the depression installation machine relative to the road, the elevational height adjustment means to further provide for controlling a respective milling action of each respective cutting tool to mill a select quantity of the road material of the road at the select positional placement location of the depression, the respective milling actions being the first milling action and any subsequent milling actions;

e) positional control means to provide for positioning the respective milling actions of the respective cutting tools at the select positional placement location to provide for a cooperation of the milling actions of the cutting tools to form the finished depression at the select positional placement location of the depression;

wherein the depression milling machine moves relative to the surface of the road and forms the finished depression at the select positional placement location utilizing the cooperation between the respective milling actions of the respective cutting tools.

12. The depression installation machine defined in claim 11 further comprising the step of repetitively forming finished depressions in a series of depressions, the series of depressions having a multiplicity of finished depressions generally aligned along a path; and wherein the first cutting tool has a series of lowered periods and a series of elevated periods, the lowered periods of the first cutting tool comprising periods of time while at least a portion of the first cutting tool is below a grade of the surface of the road, the elevated periods of the first cutting tool comprising periods of time while all of the first cutting tool is above the grade of the surface of the road; and wherein each additional cutting tool has a respective series of lowered periods and a respective series of elevated periods, the respective lowered periods of each additional cutting tool comprising periods of time while at least a portion of the respective additional cutting tool is below the grade of the surface of the road, the respective elevated periods of each additional cutting tool comprising periods of time while all of the respective additional cutting tool is above the grade of the surface of the road; and wherein the lowered periods of the first cutting tool and the respective lowered periods of each respective additional cutting tool occur on a differing schedule, whereby the differing schedule of the lowered periods of the first cutting tool and the respective lowered periods of each respective additional cutting tool provide for optimization of efficiency of the method of milling.

13. The depression installation machine defined in claim 11 wherein the elevational height adjustment means further comprises an eccentric wheel, the eccentric wheel in contact with the road during forming of the depression, the eccentric wheel having at least one camming group thereon and a support axle, each camming group to provide for an altering of an elevational height of the support axle during rotation of the eccentric wheel along the road, the support axle at least partially supporting a respective cutting tool.

14. The depression installation machine defined in claim 11 wherein the elevational height adjustment means further comprises:

a) a ground engaging wheel in contact with the road;

b) a cam member powered to rotate based on a linkage to the ground engaging wheel, the cam member having at least one camming group thereon, each camming group having a profile;

c) a rider in contact with the cam member to move along each camming group during rotation of the cam member;

d) transfer means to provide for a transfer of the profile of each camming group to a respective cutting tool.

15. The depression installation machine defined in claim 11 wherein the elevational height adjustment means further comprises:

a) a ground engaging wheel in contact with the road;

b) an electronic control member receiving an input from a rotation of the ground engaging wheel;

c) transfer means to provide for the altering of the elevational height of each of the respective cutting tool based upon an electronic signal sent by the electronic control member.

16. The depression installation machine defined in claim 11 further comprises cutting tool displacement means to provide for a movement of each respective cutting tool along the depression installation machine, the movement comprising a rearward transfer and a forward transfer, the movement to provide for each respective cutting tool to be displaced during a respective milling cycle of the respective cutting tool, the respective milling action of the respective cutting tool occurring during the rearward transfer of the respective cutting tool.

* * * * *